US009842550B2

(12) United States Patent
Im et al.

(10) Patent No.: US 9,842,550 B2
(45) Date of Patent: Dec. 12, 2017

(54) DISPLAY DEVICE

(71) Applicant: Samsung Display Co., LTD., Yongin, Gyeonggi-Do (KR)

(72) Inventors: Hyundeok Im, Seoul (KR); JaeWoong Kang, Jeonju-si (KR); Jonghyuk Kang, Suwon-si (KR); Jae Byung Park, Seoul (KR); Hyunmin Cho, Seoul (KR); Sung-Jin Hong, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 198 days.

(21) Appl. No.: 14/711,434

(22) Filed: May 13, 2015

(65) Prior Publication Data

US 2016/0155394 A1 Jun. 2, 2016

(30) Foreign Application Priority Data

Dec. 2, 2014 (KR) ..... 10-2014-0170683

(51) Int. Cl.
*G09G 3/36* (2006.01)
*G09G 3/34* (2006.01)

(52) U.S. Cl.
CPC ..... *G09G 3/3607* (2013.01); *G09G 3/3413* (2013.01); *G09G 3/3426* (2013.01); *G09G 3/3648* (2013.01); *G09G 2300/0452* (2013.01); *G09G 2310/0235* (2013.01); *G09G 2320/0242* (2013.01); *G09G 2320/0271* (2013.01)

(58) Field of Classification Search
CPC ..... G09G 3/3607
See application file for complete search history.

(56) References Cited

U.S. PATENT DOCUMENTS 8,446,547 B2 5/2013 Kim
2006/0061539 A1* 3/2006 Song ..... G02F 1/133603 345/102
2008/0185958 A1* 8/2008 Yoon ..... H01J 29/327 313/504

FOREIGN PATENT DOCUMENTS

JP 2012083664 A 4/2012
KR 1020080002301 A 1/2008
KR 1020110064089 A 6/2011
KR 1020130002781 A 1/2013
KR 1020130011404 A 1/2013

(Continued)

*Primary Examiner* — Michael Faragalla
*Assistant Examiner* — Chayce Bibbee
(74) *Attorney, Agent, or Firm* — H.C. Park & Associates, PLC

(57) ABSTRACT

A display device includes a backlight unit, a display panel, and a controller. The backlight unit comprises a plurality of first light sources in a first direction and a plurality of second light sources in the first direction. The display panel is spaced apart from the backlight unit in a third direction substantially perpendicular to the first direction and comprising an edge portion defined along at least one side thereof and a plurality of pixels. The controller generates an edge image data corresponding to a plurality of edge pixels disposed in the edge portion among the pixels, the edge image data is generated on the basis of a first angle between the third direction and a first imaginary line connecting the edge pixels and the first light sources and a second angle between the third direction and a second imaginary line connecting the edge pixels and the second light sources.

18 Claims, 10 Drawing Sheets

(56) References Cited

FOREIGN PATENT DOCUMENTS

| | | | |
|---|---|---|---|
| KR | 1020130030877 | A | 3/2013 |
| KR | 1020130052298 | A | 5/2013 |
| KR | 1020130126396 | A | 11/2013 |

* cited by examiner

FIG. 8

LUT1

| $x$ | $\theta_1$ | $\theta_2$ | $k_1$ |
|---|---|---|---|
| $x_1$ | $\theta_{11}$ | $\theta_{21}$ | $k_{11}$ |
| ⋮ | ⋮ | ⋮ | ⋮ |
| $x_n$ | $\theta_{1n}$ | $\theta_{2n}$ | $k_{1n}$ |

First look-up table

LUT2

| $x$ | $\theta_1$ | $\theta_2$ | $k_2$ |
|---|---|---|---|
| $x_1$ | $\theta_{11}$ | $\theta_{21}$ | $k_{21}$ |
| ⋮ | ⋮ | ⋮ | ⋮ |
| $x_n$ | $\theta_{1n}$ | $\theta_{2n}$ | $k_{2n}$ |

Second look-up table

DISPLAY DEVICE

CLAIM OF PRIORITY

This U.S. non-provisional patent application claims the priority of and all the benefits accruing under 35 U.S.C. §119 of Korean Patent Application No. 10-2014-0170683, filed on Dec. 2, 2014 in the Korean Intellectual Property Office ("KIPO"), the contents of which are hereby incorporated by reference in its entirety.

BACKGROUND OF THE INVENTION

Field of the Invention

The present disclosure relates to a display device capable of preventing a color stain from occurring.

Description of the Related Art

As one of flat panel displays, a liquid crystal display is widely used in various electric devices, such as a television set, a computer monitor, a notebook computer, a mobile phone, etc., to display an image.

The liquid crystal display controls intensity of an electric field applied to a liquid crystal material interposed between two substrates and an amount of light passing through the two substrates to display the image. The liquid crystal display includes a liquid crystal display panel displaying the image and a backlight unit providing the liquid crystal display panel with the light.

The backlight unit is classified into an edge-illumination type backlight unit and a direct-illumination type backlight unit according to a position of a light source thereof. The edge-illumination type backlight unit includes a light guide plate and the light source providing the light to a side surface of the light guide plate, and the direct-illumination type backlight unit includes a diffusion plate and a light source disposed under the diffusion plate.

SUMMARY OF THE INVENTION

The present disclosure provides a display device capable of preventing a color stain from occurring.

Embodiments of the inventive concept provide a display device including a backlight unit, a display panel, and a controller. The backlight unit comprises a first light source substrate comprising a plurality of first light sources arranged in a first direction and a second light source substrate disposed adjacent to the first light source substrate in a second direction and comprising a plurality of second light sources arranged in the first direction. The display panel is disposed to be spaced apart from the backlight unit in a third direction substantially perpendicular to the first and second direction and comprising an edge portion defined along at least one side thereof and a plurality of pixels. The controller generates an edge image data corresponding to a plurality of edge pixels disposed in the edge portion among the pixels, wherein the edge image data is generated on the basis of a first angle between the third direction and a first imaginary line connecting the edge pixels and the first light sources and a second angle between the third direction and a second imaginary line connecting the edge pixels and the second light sources The edge portion is disposed in the second direction of the display panel, the display panel includes a center portion disposed adjacent to the edge portion in a fourth direction opposite to the second direction, the second light source substrate is disposed to correspond to the edge portion, and the first light source substrate is disposed adjacent to the second edge light source substrate in the fourth direction to correspond to the center portion.

The controller includes a compensation block, and the compensation block compensates for edge image signals corresponding to the edge pixels among image signals provided thereto from the outside on the basis of a compensation value (k1) generated based on the first and second angles to generate edge compensation data and generates the edge image data using the edge compensation data.

The compensation value (k1) is generated using $\cos^2(\Theta_1)$ and $\cos^2(\Theta_2)$, $\Theta_1$ denotes the first angle, and $\Theta_2$denotes the second angle.

The compensation value (k1) satisfies the following Equation of $$k1 = A\left(\frac{f(\theta_2)}{f(\theta_1)}\right)^{\frac{1}{\gamma}},$$

$f(\Theta_1)$ is equal to $\cos^2(\Theta_1)$, $f(\Theta_2)$ is equal to $\cos^2(\Theta_2)$, $\gamma$ is a gamma tuning value of the display panel, and A is a compensation constant.

The edge image signal includes a red image signal, a green image signal, and a blue image signal, the edge compensation data includes red, green, and blue compensation data, the red and green compensation data are generated by compensation for the red and green image signals on the basis of the compensation value (k1), and the blue compensation data are generated to have a value of the blue image signal.

The red and green compensation data are generated by multiplying the compensation value (k1) by the red and green image signals.

The edge image data includes an edge red image data, an edge green image data, and an edge blue image data, the edge red and green image data are generated to have values of the red and green image signals when the red or green compensation data has a grayscale value greater than a maximum grayscale value, the edge blue image data is generated by multiplying a reverse compensation value (k2) by the blue compensation data, and the reverse compensation value (k2) satisfies the following Equation of $$k2 = \frac{1}{k1}.$$

The edge red, green, and blue image data are generated to have the red, green, and blue compensation data respectively when the red and green compensation data have the grayscale value smaller than the maximum grayscale value.

The compensation block generates the edge compensation data with reference to a look-up table and the look-up table stores the compensation value (k1) in accordance with the first and second angles.

The look-up table includes a first look-up table storing the compensation value (k1) in accordance with the first and second angles and a second look-up table storing the reverse compensation value (k2) in accordance with the first and second angles, and the compensation block refers to the first look-up table when the red and green compensation data have the grayscale value smaller than the maximum grayscale value and refers to the second look-up table when the red or green compensation data have the grayscale value greater than the maximum grayscale value.

The first light source emits a yellow light and the second light source emits a blue light.

The backlight unit is operated in a time division fashion in synchronization with first and second fields obtained by timely dividing a frame, the first light source emits the yellow light during the first field, and the second light source emits the blue light during the second field.

Each of the pixels includes a red sub-pixel including a red color filter, a green sub-pixel including a green color filter, and a transparent sub-pixel including a transmission part.

The first light source substrates are operated during the first field and the second light source substrates are operated during the second field.

The edge image signal includes a red image signal, a green image signal, and a blue image signal and the edge compensation data includes red, green, and blue compensation data. When the red or green image signal has a grayscale value greater than a maximum grayscale value, the red, green, and blue compensation data are generated to have the red and green image signals, the blue compensation data is generated on the basis of the blue image signal and a reverse compensation value (k2), and the reverse compensation value (k2) satisfies the following Equation of $$k2 = \frac{1}{k1}.$$

The blue compensation data is generated by multiplying the reverse compensation value (k2) by the blue image signal.

A distance between a center of the first light source substrate and a boundary between the edge portion and the center portion is substantially equal to a distance between the boundary and a center of the second light source substrate.

According to the above, the edge image signals applied to the edge pixels are compensated on the basis of the first angle with respect to the first light source and the second angle with respect to the second light source. Thus, the color stain may be prevented from occurring on the edge portion.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein:

FIG. 8 is a view showing first and second look-up table shown in FIG. 6;

DETAILED DESCRIPTION OF THE INVENTION

Figure 1:
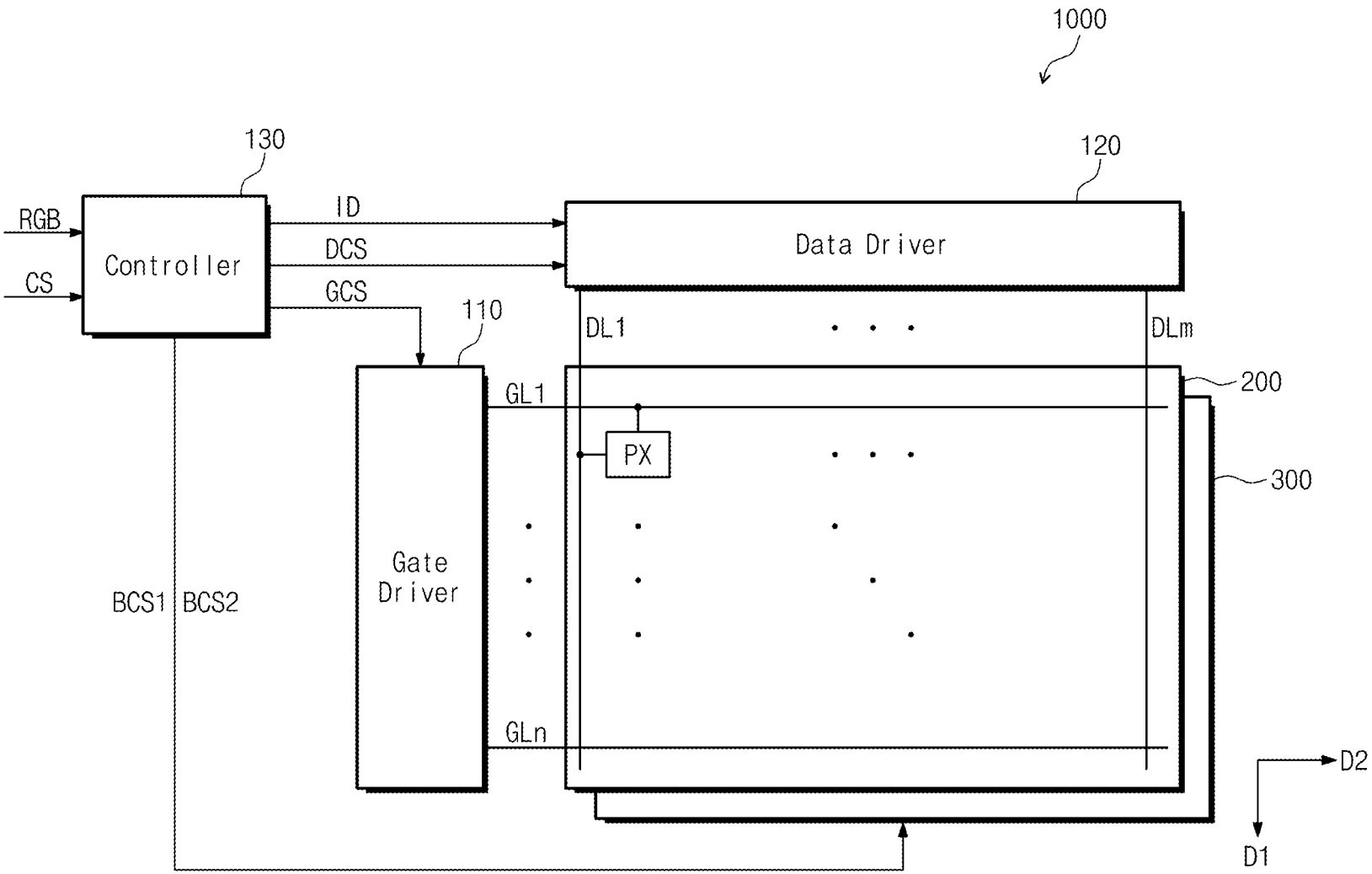
FIG. 1 is a block diagram showing a display device according to an exemplary embodiment of the present disclosure.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a block diagram showing a display device 1000 according to an exemplary embodiment of the present disclosure.

Referring to FIG. 1, the display device 1000 includes a display panel 200 to display an image, gate and data drivers 110 and 120 to drive the display panel 200, and a controller 130 to control the gate and data drivers 110 and 120 and a driving scheme of the display panel 200.

The controller 130 receives image signals RGB and control signals CS. The controller 130 converts a data format of the image signals RGB to a data format appropriate to an interface between the data driver 120 and the controller 130 to generate image data ID and applies the image data ID to the data driver 120.

The controller 130 generates a data control signal DCS, e.g., an output start signal, a horizontal start signal, etc., and a gate control signal GCS, e.g., a vertical start signal, a vertical clock signal, a vertical clock bar signal, etc., on the basis of the control signal CS. The data control signal DCS is applied to the data driver 120 and the gate control signal GCS is applied to the gate driver 110.

The gate driver 110 sequentially outputs gate signals in response to the gate control signal GCS provided from the controller 130.

The data driver 120 converts the image data ID to data voltages in response to the data control signal DCS provided from the controller 130. The data voltages are applied to the display panel 200.

The display panel 200 includes a plurality of gate lines GL1 to GLn, a plurality of data lines DL1 to DLm, and a plurality of pixels PX.

The gate lines GL1 to GLn extend in a second direction D2 and are arranged in a first direction D1 substantially perpendicular to the second direction D2 to be substantially parallel to each other. The gate lines GL1 to GLn are connected to the gate driver 110 to receive the gate signals from the gate driver 110.

The data lines DL1 to DLm extend in the first direction D1 and are arranged in the second direction D2 to be substantially parallel to each other. The data lines DL1 to DLm are connected to the data driver 120 to receive the data voltages from the data driver 120.

Each pixel PX is connected to a corresponding gate line of the gate lines GL1 to GLn and a corresponding data line of the data lines DL1 to DLm.

The display device 1000 may further include a backlight unit 300. The backlight unit 300 receives first and second backlight control signals BCS1 and BCS2 generated by the controller 130. The backlight unit 300 generates a light in response to the first and second backlight control signals BCS1 and BCS2 and provides the display panel 200 with the light.

Each pixel PX includes a plurality of sub-pixels. Hereinafter, a structure and an operation of one sub-pixel will be described in detail as a representative example.

Figure 2:
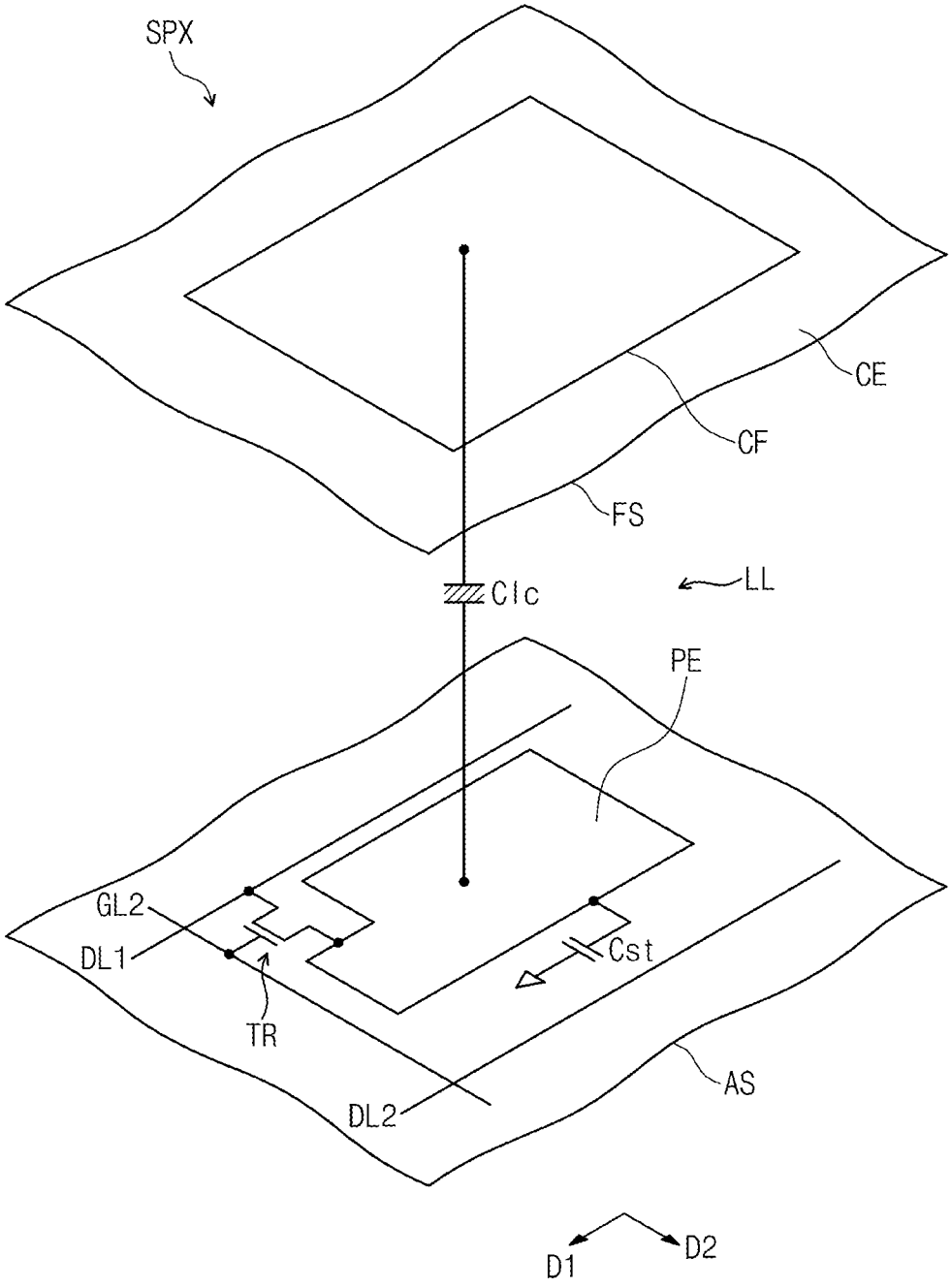
FIG. 2 is a view showing a sub-pixel.

FIG. 2 is a view showing the sub-pixel SPX.

Referring to FIG. 2, the display panel 200 includes an array substrate AS, an opposite substrate FS, and a liquid crystal layer LL interposed between the array substrate AS and the opposite substrate FS.

The sub-pixel SPX includes a transistor TR connected to the second gate line GL2 and the first data line DL1, a liquid crystal capacitor Clc connected to the transistor TR, and a storage capacitor Cst connected to the liquid crystal capacitor Clc in parallel. The storage capacitor Cst may be omitted.

The transistor TR is disposed on the array substrate AS. The transistor TR includes a gate electrode connected to the second gate line GL2, a source electrode connected to the first data line DL1, and a drain electrode connected to the liquid crystal capacitor Clc and the storage capacitor Cst.

The liquid crystal capacitor Clc includes a pixel electrode PE disposed on the array substrate AS, a common electrode CE disposed on the opposite substrate FS, and the liquid crystal layer LL disposed between the pixel electrode PE and the common electrode CE. In this case, the liquid crystal layer LL serves as a dielectric substance. The pixel electrode PE is connected to the drain electrode.

The common electrode CE is disposed over an entire surface of the opposite substrate FS, but it should not be limited thereto or thereby. The common electrode CE is disposed on the array substrate AS. In this case, at least one of the pixel electrode PE and the common electrode CE may include slits.

The storage capacitor Cst includes the pixel electrode PE, a storage electrode (not shown) branched from a storage line (not shown), and an insulating layer disposed between the pixel electrode PE and the storage electrode. The storage line is disposed on the array substrate AS and disposed on the same layer as the second gate line GL2. The storage electrode partially overlaps the pixel electrode PE.

The sub-pixel SPX further includes a color filter CF displaying one of primary colors. The color filter CF is disposed on the opposite substrate FS, but it should not be limited thereto or thereby. The color filter CF may be disposed on the array substrate AS.

The transistor TR is turned on in response to the gate signal provided through the second gate line GL2. The data voltage provided through the first data line DL1 is applied to the pixel electrode PE of the liquid crystal capacitor Clc through the turned-on transistor TR. The common electrode CE is applied with a common voltage.

Due to a difference in voltage level between the data voltage and the common voltage, an electric field is formed between the pixel electrode PE and the common electrode CE. Liquid crystal molecules of the liquid crystal layer LL are operated by the electric field formed between the pixel electrode PE and the common electrode CE. A transmittance of the light incident to the liquid crystal layer LL is controlled by the liquid crystal molecules operated by the electric field, and thus a desired image is displayed.

The storage line is applied with a storage voltage having a constant voltage, but it should not be limited thereto or thereby. That is, the storage line may be applied with the common voltage. The storage capacitor Cst maintains the voltage charged in the liquid crystal capacitor Clc.

Figure 3:
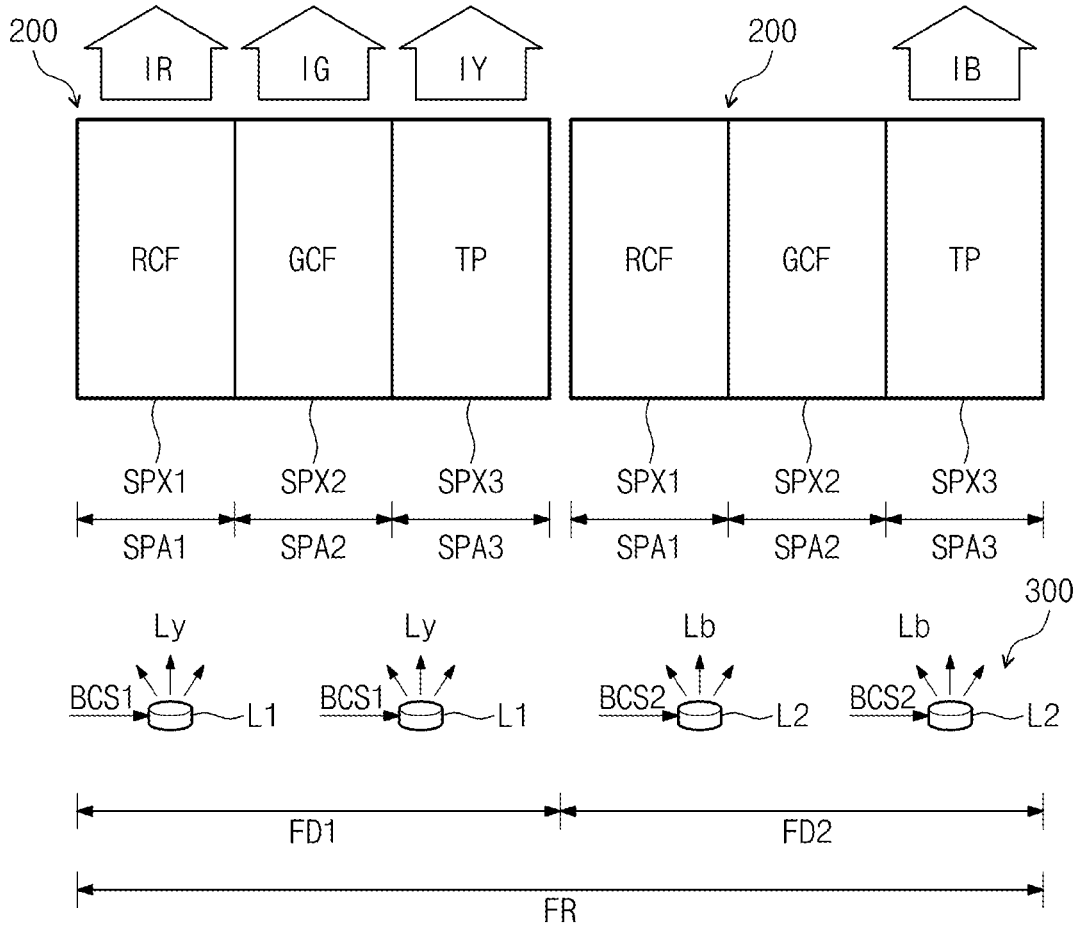
FIG. 3 is a view showing a principle of realizing a full color image using time and space division schemes.

FIG. 3 is a view showing a principle of realizing a full color image using time and space division schemes.

The sub-pixel may be one of first, second, and third sub-pixels SPX1, SPX2, and SPX3 displaying different colors from each other. In the present exemplary embodiment, the first, second, and third sub-pixels SPX1, SPX2, and SPX3 are a red sub-pixel, a green sub-pixel, and a transparent sub-pixel, respectively.

Areas respectively corresponding to the first, second, and third sub-pixels SPX1, SPX2, and SPX3 are referred to as first, second, and third sub-pixel areas SPA1, SPA2, and SPA3. In this case, first and second color filters are respectively disposed in the first and second sub-pixel areas SPA1 and SPA2 and a transmission part TP is disposed in the third sub-pixel area SPA3.

The first color filter is a red color filter RCF that filters the light traveling thereto and transmits only a red light component. The second color filter is a green color filter GCF that filters the light traveling thereto and transmits only a green light component.

The backlight unit 300 includes a first light source L1 and a second light source L2. The first light source L1 emits a first light having a first color and the second light source L2 emits a second light having a second color different from the first color.

As an example, the first and second colors are in a complementary color relation. For instance, a mixed color of the first and second colors may be a white color.

In the present exemplary embodiment, the first color is a yellow color and the second color is a blue color. That is, the first and second lights are a yellow light Ly and a blue light Lb, respectively, but they should not be limited thereto or thereby. That is, each of the first and second colors may be one of red, green, magenta, and cyan colors.

The first or second light source L1 or L2 includes a light emitting diode. The light emitting diode includes a light emitting chip, a fluorescent substance, and a lens part. The fluorescent substance is coated on the light emitting chip to cover the light emitting chip. The lens part covers the light emitting chip and the fluorescent substance. As an example, the first light source L1 includes a blue light emitting diode to generate the blue light Lb and the second light source L2 includes a yellow light emitting diode to generate the yellow light Ly.

A frame FR is divided into first and second fields FD1 an FD2 according to a time sequence. In the first field FD1, the first light source L1 is operated in response to the first backlight control signal BCS1 and the yellow light Ly is emitted from the first light source L1. Then, in the second field FD2, the second light source L2 is operated in response to the second backlight control signal BCS2 and the blue light Lb is emitted from the second light source L2.

Accordingly, during the first field FD1, the red light component of the yellow light Ly emitted from the yellow light emitting diode transmits through the red color filter RCF and is displayed as a red image IR, and the green light component of the yellow light Ly emitted from the yellow light emitting diode transmits through the green color filter GCF and is displayed as a green image IG. In addition, the yellow light Ly transmits through the transmission part TP and is displayed as a yellow image IY.

Then, during the second field FD2, the blue light Lb emitted from the blue light emitting diode L2 transmits through the transmission part TP and is displayed as a blue image IB. However, since the blue light Lb does not transmit through the red and green color filters RCF and GCF, the image is not displayed through the first and second pixel areas PA1 and PA2.

As described above, the yellow image IY is displayed during the first field FD1 by the transmission part TP and the blue image IB is displayed during the second field FD2 by the transmission part TP. The transmission part TP does not include the color filter, and thus the transmission part TP transmits the yellow and blue lights Ly and Lb without a light loss. Therefore, a light use efficiency of the display device 1000 (refer to FIG. 1) is improved.

Figure 4:
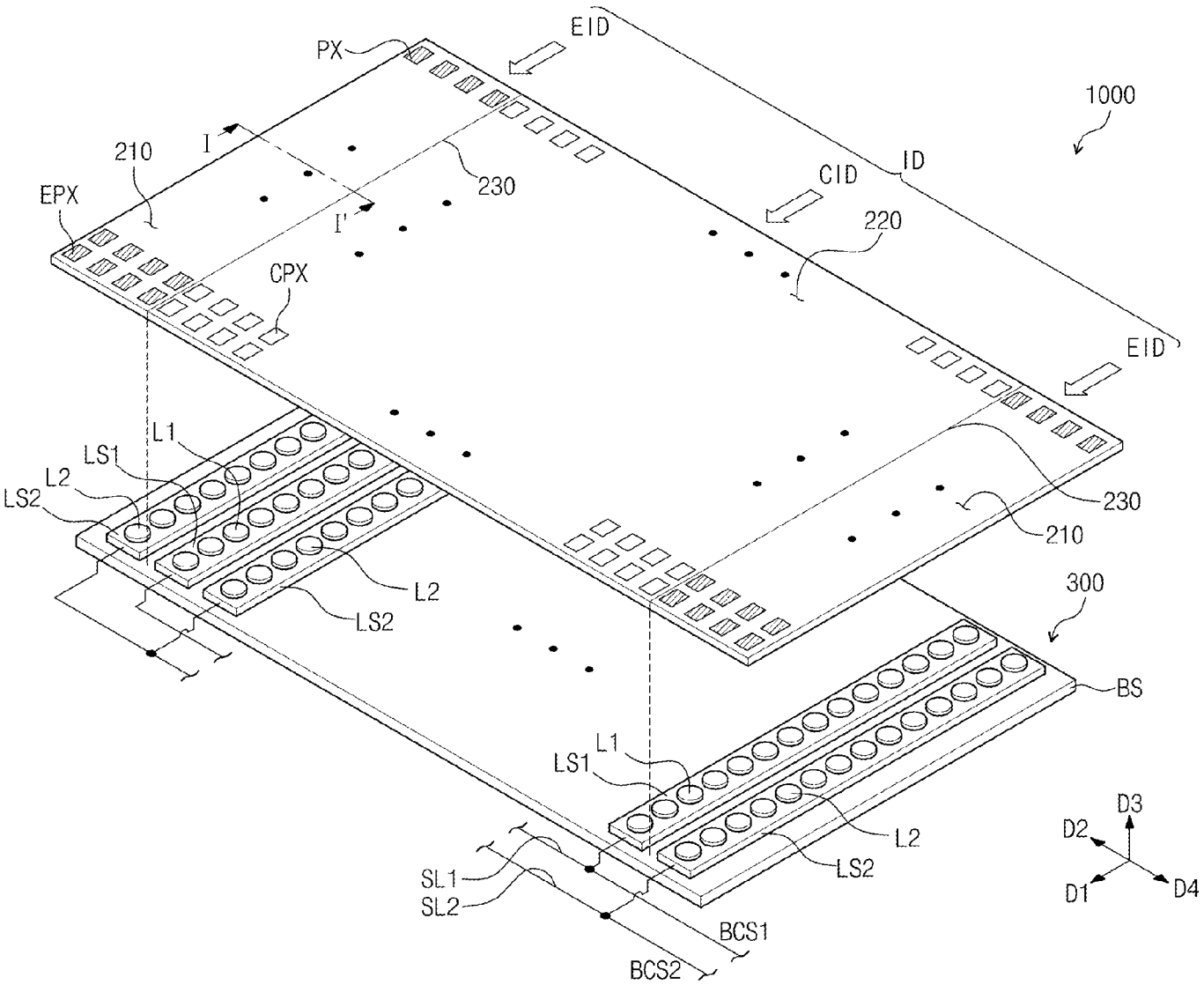
FIG. 4 is a perspective view showing a display panel and a backlight unit shown in FIG. 1.

FIG. 4 is a perspective view showing a display panel 200 and a backlight unit 300 shown in FIG. 1.

Referring to FIG. 4, the backlight unit 300 includes a first light source substrate LS1, a second light source substrate LS2, and a base BS. Each of the first and second light source substrates LS1 and LS2 is provided in a plural number on the base substrate BS. The first and second light source substrates LS1 and LS2 are alternately arranged in the second direction D2. As an example, the first and second light source substrates LS1 and LS2 are arranged in order of the second light source substrate LS2 the first light source substrate LS1/ . . . /the second light source substrate LS2.

The first light source substrate LS1 has a substantially bar shape elongated in the first direction D1. The first light source L1 is provided in a plural number and the first light sources L1 are mounted on the first light source substrate LS1. The first light source substrate LS1 includes lines that transmit signals to drive the first light sources L1. The first light source substrate LS1 includes a printed circuit board.

The first light sources L1 are arranged on the first light source substrate LS1 in a line shape substantially parallel to the first direction D1. The first light sources L1 are connected to each other by the lines of the first light source substrate LS1 to form one LED string.

The first light source substrates LS1 are connected to a first substrate line SL1. The first light source substrates LS1 receive the first backlight control signal BCS1 through the first substrate line SL1. The first light sources L1 of the first light source substrates LS1 are operated during the first field FD1 (refer to FIG. 3) in response to the first backlight control signal BCS1.

The second light source substrate LS2 has a substantially bar shape elongated in the first direction D1. The second light source L2 is provided in a plural number and the second light sources L2 are mounted on the second light source substrate LS2. The second light source substrate LS2 includes lines that transmit signals to drive the second light sources L2. The second light source substrate LS2 includes a printed circuit board.

The second light sources L2 are arranged on the second light source substrate LS2 in a line shape substantially parallel to the first direction D1. The second light sources L2 are connected to each other by the lines of the second light source substrate LS2 to form one LED string.

The second light source substrates LS2 are connected to a second substrate line SL2. The second light source substrates LS2 receive the second backlight control signal BCS2 through the second substrate line SL2. The second light sources L2 of the second light source substrates LS2 are operated during the second field FD2 (refer to FIG. 3) in response to the second backlight control signal BCS2.

The display panel 200 has a substantially rectangular shape. The display panel 200 includes an edge portion 210 defined along sides substantially parallel to the first direction D1 among four sides thereof. Accordingly, the edge portion 210 has the rectangular shape elongated along the first direction D1.

As an example, the display panel 200 includes two edge portions 210 defined therein. One edge portion 210 is defined along the side disposed in the second direction D2 and the other edge portion 210 is defined along the side disposed in a fourth direction D4 opposite to the second direction D2. A center portion 220 is defined between the edge portions 210. Since the edge portions 210 have the same structure, hereinafter, the edge portion 210 in the second direction D2 will be mainly described.

Hereinafter, among the pixels PX, the pixels disposed in the edge portion 210 will be referred to as edge pixels EPX and the pixels disposed in the center portion 220 will be referred to as center pixels CPX.

Figure 5:
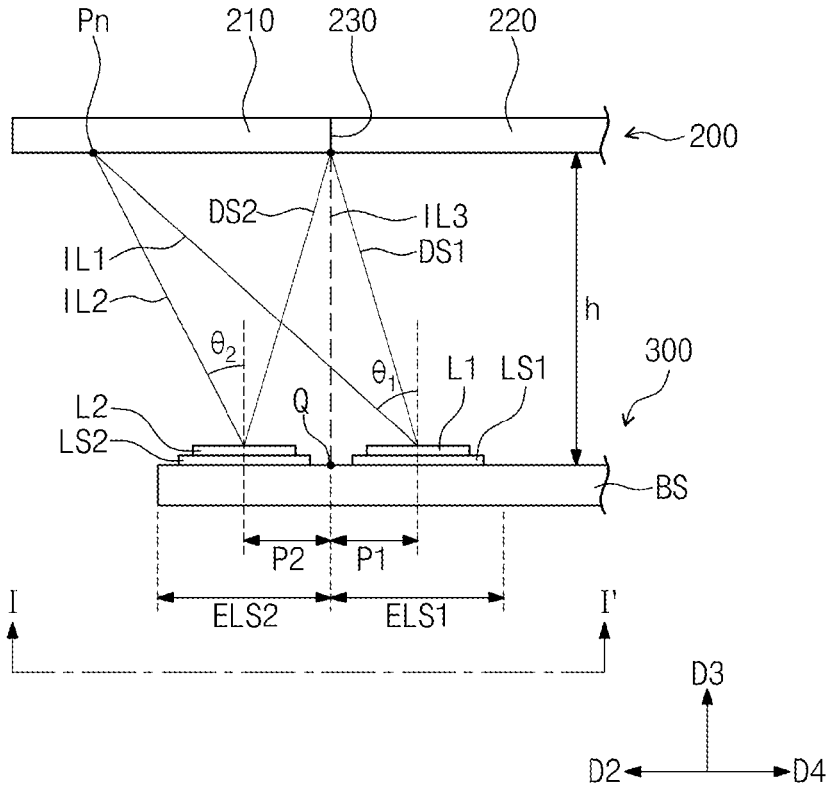
FIG. 5 is a cross-sectional view taken along a line I-I' shown in FIG. 4.

FIG. 5 is a cross-sectional view taken along a line I-I' shown in FIG. 4.

Referring to FIGS. 4 and 5, the display panel 200 includes a boundary 230 defined between the edge portion 210 and the center portion 220. The boundary 230 is defined as viewed relative to first and second edge light source substrates ELS1 and ELS2. In more detail, the boundary 230 is defined such that a first distance DS1 between each position on the boundary 230 and a center of the first edge light source substrate ELS1 is substantially equal to a second distance DS2 between each position on the boundary 230 and a center of the second edge light source substrate ELS2.

Here, the second edge light source substrate ELS2 is disposed at an outermost position in the second direction D2 of the second light source substrates LS2. The second edge light source substrate ELS2 is disposed under the edge portion 210. The first edge light source substrate ELS1 is disposed adjacent to the second edge light source substrate ELS2 in the fourth direction D4. The first edge light source substrate ELS1 is disposed at an outermost position in the second direction D2 of the first light source substrates LS1.

The yellow light Ly, which is emitted from the first light source L1 of the first edge light source substrate ELS1 and reaches an arbitrary point Pn of the edge portion 210, has a first brightness determined by a first angle $\Theta_1$. The first angle $\Theta_1$corresponds to an angle between a first imaginary line IL1 passing through the arbitrary point Pn and the first light source L1 of the first edge light source substrate ELS1 and the third direction D3.

The first angle this obtained by the following Equation 1.

$$\theta_1 = \tan^{-1}\left(\frac{Xp + p1}{h}\right) \quad \text{Equation 1}$$

In Equation 1, Xp denotes a distance between the boundary 230 and the arbitrary point Pn, h denotes a distance between the first light source substrate LS1 and the display panel 200, and p1 denotes a distance between a center portion of the first light source L1 and a point Q at which a third imaginary line IL3 passing through the boundary 230 and substantially parallel to the third direction D3 meets the base BS.

The first brightness is proportional to $\cos^2(\Theta_1)$. Therefore, as the first angle $\Theta_1$ becomes large, the first brightness becomes low.

The blue light Lb, which is emitted from the second light source L2 of the second edge light source substrate ELS2 and reaches the arbitrary point Pn, has a second brightness determined by a second angle $\Theta_2$. The second angle $\Theta_2$ corresponds to an angle between a second imaginary line IL2 passing through the arbitrary point Pn and the second light source L2 of the second edge light source substrate ELS2 and the third direction D3.

The second angle $\Theta_2$ is obtained by the following Equation 2.

$$\theta_2 = \tan^{-1}\left(\frac{Xp - p2}{h}\right) \quad \text{Equation 2}$$

In Equation 2, p2 denotes a distance between the point Q and a center portion of the second light source L2. Since the first distance DS1 is equal to the second distance DS2, the "p1" is equal to the "p2".

The second brightness is proportional to $\cos^2(\Theta_2)$. Thus, as the second angle $\Theta_2$ becomes large, the second brightness becomes low.

Since the first and second edge light source substrates ELS1 and ELS2 are spaced apart from each other by 2×p1 (or 2×p2), a difference occurs between the first and second angles $\Theta_1$ and $\Theta_2$ with respect to the arbitrary point Pn, and as a result, a difference occurs between the first brightness and the second brightness. Accordingly, due to the difference in brightness between the yellow light Ly and the blue light Lb and the difference in color between the yellow light Ly and the blue light Lb, a color stain appears on the edge portion 210.

In more detail, the second angle $\Theta_2$ is smaller than the first angle $\Theta_1$. Therefore, since the second brightness is greater than the first brightness, an image that is more bluish than the original image is displayed in the edge portion 210.

However, according to the present exemplary embodiment, the color stain may be prevented from occurring. In detail, as shown in FIG. 4, the image data ID includes edge image data EID and center image data CID. The edge image data EID are applied to the edge pixels EPX and compensated on the basis of the first and second angles $\Theta_1$ and $\Theta_2$ and thus the color stain may be prevented from occurring. Meanwhile, the center image data CID are applied to the center pixels CPX, but not compensated on the first and second angles $\Theta_1$ and $\Theta_2$.

Figure 6:
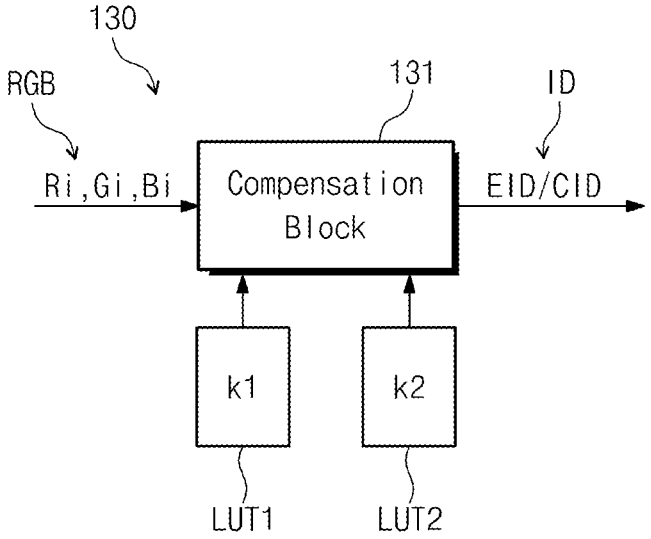
FIG. 6 is a block diagram showing a controller shown in FIG. 1.
Figure 7:
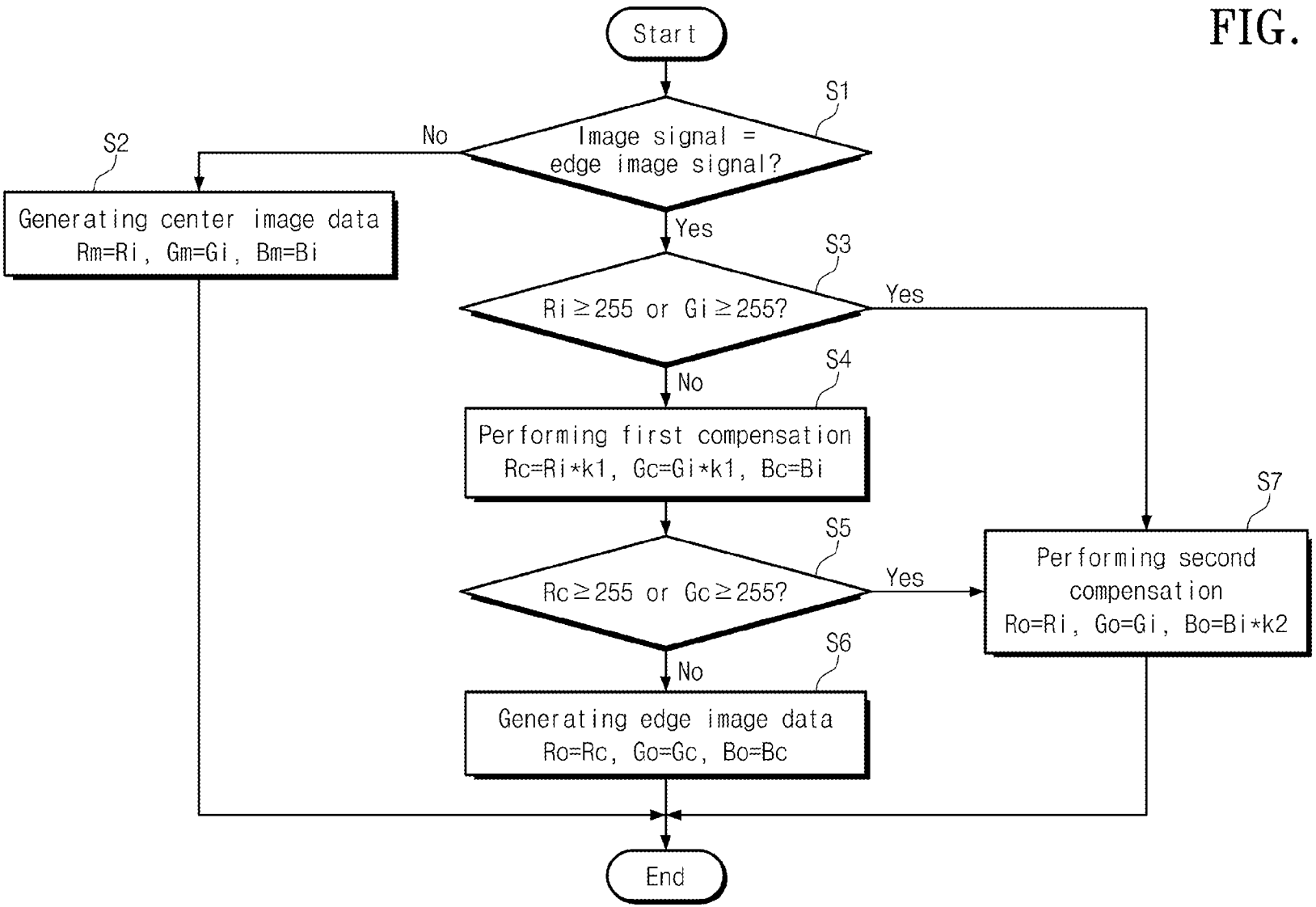
FIG. 7 is a flowchart showing an operation of a compensation block shown in FIG. 6.

FIG. 6 is a block diagram showing the controller 130 shown in FIG. 1 and FIG. 7 is a flowchart showing an operation of a compensation block shown in FIG. 6.

Referring to FIGS. 6 and 7, the controller 130 includes a compensation block 131.

The compensation block 131 receives the image signals RGB and generates the edge image data EID and the center image data CID. The image signals RGB include a red image signal Ri, a green image signal Gi, and a blue image signal Bi, which respectively include information about a red image, information about a green image, and information about a blue image.

The compensation block 131 checks that whether the image signals RGB are the edge image signals corresponding to the edge pixels EPX or the center image signals corresponding to the center pixels CPX (S1).

When the image signals RGB are the center image signals, the compensation block 131 generates the center image data CID on the basis of the image signals RGB. In more detail, center red, green, and blue data Rm, Gm, and Bm of the center image data CID are generated to include the red, green, and blue image signals Ri, Gi, and Bi, respectively (S2).

When the image signals RGB are the edge image signals, the compensation block 131 checks that whether the red image signal Ri or the green image signal Gi has a grayscale value greater than a maximum grayscale value or not (S3). The maximum grayscale value means the greatest grayscale value represented by each pixel PX, e.g., 255 grayscale value.

When the red image signal Ri or the green image signal Gi has the grayscale value smaller than the maximum grayscale value, the compensation block 131 compensates for the image signals RGB on the basis of a compensation value k1 to generate edge compensation data ECD (S4). Hereinafter, the process of compensating for the image signal on the basis of the compensation value k1 will be referred to as a first compensation.

The compensation value k1 is generated on the basis of the first and second angles $\Theta_1$ and $\Theta_2$. As an example, the compensation value k1 is generated using $\cos^2(\Theta_1)$ and $\cos^2(\Theta_2)$. The compensation value k1 satisfies the following Equation 3.

$$k1 = A\left(\frac{f(\theta_2)}{f(\theta_1)}\right)^{\frac{1}{\gamma}} \quad \text{Equation 3}$$

In Equation 3, $f(\Theta_1)$ is equal to $\cos^2(\Theta_1)$, $f(\Theta_2)$ is equal to $\cos^2(\Theta_2)$, $\gamma$ is a gamma tuning value of the display panel 200, A is a compensation constant. The gamma tuning value ($\gamma$) is to compensate for gamma characteristics of the display panel 200. The compensation constant (A) is a proportional constant and is to compensate for a variation in amount of the light, which is caused by an optical sheet (not shown) and the display panel 200 of the display device 1000.

In more detail, red and green compensation data Rc and Gc of the edge compensation data ECD are generated on the basis of the compensation value k1. For instance, the red and green compensation data Rc and Gc are generated by multiplying the red and green image signals Ri and Gi by the compensation value k1.

Blue compensation data Bc of the edge compensation data ECD are generated to have the value of the blue image signal Bi.

Then, the compensation block 131 checks that whether the red compensation data Rc or the green compensation data Gc has the grayscale value greater than the maximum grayscale value (S5).

When the red compensation data Rc or the green compensation data Gc has the grayscale value smaller than the maximum grayscale value, the compensation block 131 generates the edge image data EID on the basis of the edge compensation data ECD (S6). In more detail, edge red, edge green, and edge blue image data Ro, Go, and Bo of the edge image data EID are generated to have the red, green, and blue compensation data Rc, Gc, and Bc, respectively.

When the red image signal Ri or the green image signal Gi has the grayscale value greater than the maximum grayscale value in the checking that whether the red image signal Ri or the green image signal Gi has the grayscale value greater than the maximum grayscale value (S3), the compensation block 131 compensates for the image signals RGB on the basis of a reverse compensation value k2 to generate the edge image data EID (S7). Hereinafter, the process of compensating for the image signals RGB on the basis of the reverse compensation value k2 will be referred to as a second compensation.

Here, the reverse compensation value k2 is generated on the first and second angles $\Theta_1$ and $\Theta_2$. In the present exemplary embodiment, the reverse compensation value k2 satisfies the following Equation 4.

$$k2 = \frac{1}{k1} \quad \text{Equation 4}$$

In more detail, the edge blue image data Bo of the edge image data EID are generated on the basis of the reverse compensation value k2. For instance, the edge blue image data Bo is generated by multiplying the blue image signal Bi by the reverse compensation value k2.

Meanwhile, the edge red image data Ro and the edge green image Go of the edge image data EID are generated to have the values of the red and green image signals Ri and Gi, respectively.

In addition, when the red compensation data Rc or the green compensation data Gc has the grayscale value greater than the maximum grayscale value in the checking that whether the red compensation data Rc or the green compensation data Gc has the grayscale value greater than the maximum grayscale value, the compensation block 131 compensates for the image signals RGB on the basis of the reverse compensation value k2 to generate the edge image data EID (S7).

As described above, when the edge image data EID are generated by the first compensation or the second compensation, the color stain appearing on the edge portion 210 (refer to FIG. 4) may be removed.

For instance, when the red, green, and blue image signals Ri, Gi, and Bi have the grayscale values of 200, 200, and 200, respectively, the red and green image signals R1 and Gi are smaller than the maximum grayscale, e.g., 255 grayscale value (S3), and thus first compensation is carried out (S4). As an example, the compensation value k1 may be about 1.07. The red, green, and blue compensation data Rc, Gc, and Bc generated by carrying out the first compensation (S4) have the grayscale values of 215, 215, and 200, respectively. Since the red and green compensation data Rc and Gc are smaller than 255 grayscale value (S5), the edge red, edge green, and edge blue image data Ro, Go and Bo are generated to have the grayscale values of 215, 215, and 200, respectively (S6).

Consequently, the grayscale values of the edge red image data Ro and the edge green image data Go have the grayscale value compensated on the basis of the first and second angles $\Theta 1$ and $\Theta 2$ such that the grayscale values of the edge red image data Ro and the edge green image data Go are greater than 200 grayscale value of the red and green image signals Ri and Gi. The image displayed in the edge pixels EPX in response to the edge red, green, and blue image data Ro, Go, and Bo includes a yellow component much more than that of the original image. Accordingly, the color stain that is bluish and appears on the edge portion 210 is offset and the color stain is removed.

On the contrary, when the red, green, and blue image signals Ri, Gi, and Bi have the grayscale values of 255, 255, and 200, respectively, the red and green image signals Ri and Gi are greater than the maximum grayscale value, e.g., 255 grayscale value (S3), and thus the second compensation is carried out. As an example, the reverse compensation value k2 satisfies the following Equation of 1/compensation value (k1)=1/1.07=0.93. The edge red, green, and blue image data Ro, Go, and Bo generated by carrying out the first compensation (S4) have the grayscale values of 200, 200, and 186, respectivley.

Consequently, the grayscale value of the edge blue image data Bo has the grayscale value compensated on the basis of the first and second angles $\Theta 1$ and $\Theta 2$ such that the grayscale value of the edge blue image data Bo is smaller than 200 grayscale value of the blue image signals Bi. Thus, the image displayed in the edge pixels EPX in response to the edge red, green, and blue image data Ro, Go, and Bo includes a blue component much less than that of the original image. Accordingly, the color stain that is bluish and appears on the edge portion 210 is removed.

As shown in FIG. 6, the controller 130 includes a first look-up table LUT1 and a second look-up table LUT2. The compensation block 131 performs the first compensation on the basis of the first look-up table LUT1 and performs the second compensation on the basis of the second look-up table LUT2.

Figure 9:
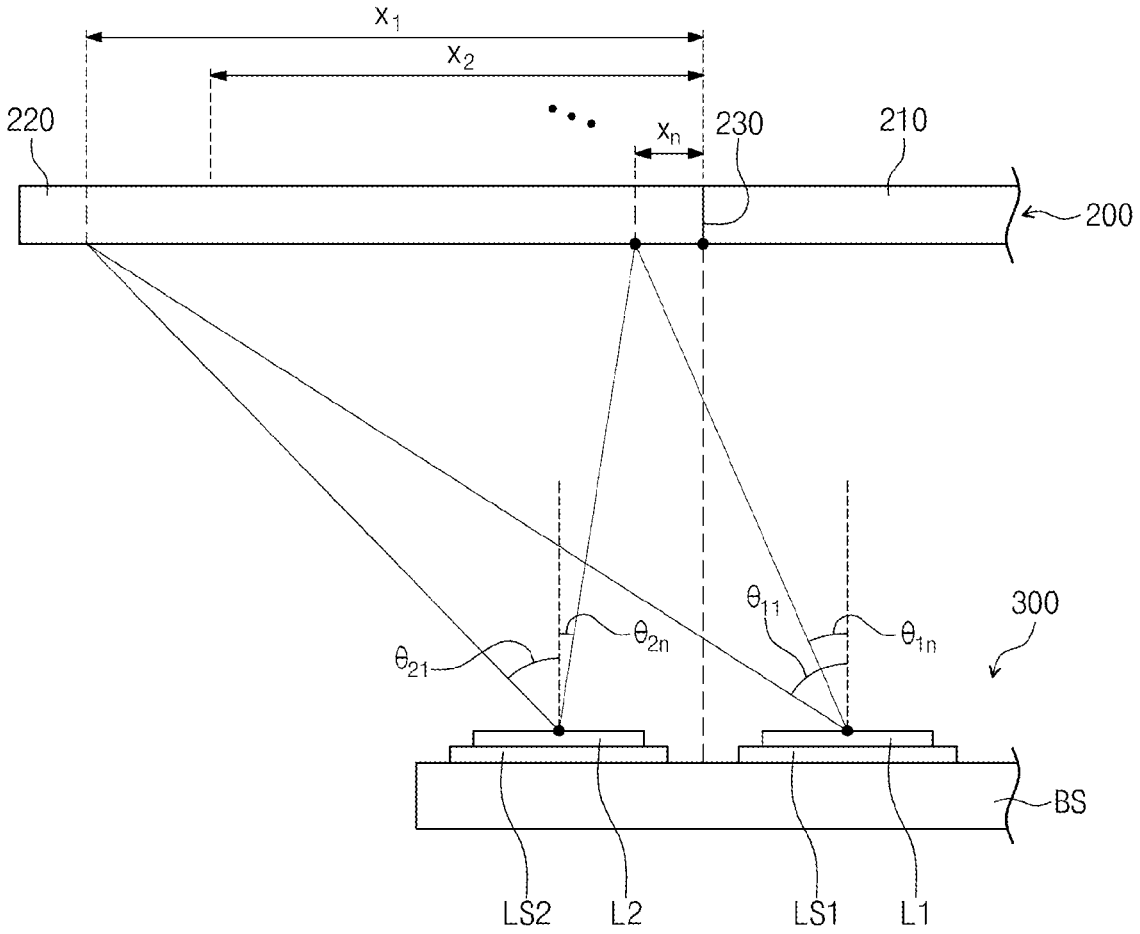
FIG. 9 is a view showing a compensation value and a reverse compensation value according to first and second angles.

FIG. 8 is a view showing the first and second look-up tables LUT1 and LUT2 shown in FIG. 6 and FIG. 9 is a view showing the compensation value and the reverse compensation value according to the first and second angles $\Theta_1$ and $\Theta_2$.

Hereinafter, the compensation value k1 and the reverse compensation value k2 stored into the first and second look-up tables LUT1 and LUT2 will be described in detail with reference to FIGS. 7 to 9.

The first look-up table LUT1 stores the compensation value k1 therein. In more detail, the first look-up table LUT1 stores the first and second angles $\Theta_1$ and $\Theta_2$ in accordance with a distance x and the compensation value k1 as shown in FIG. 8.

As shown in FIG. 9, the distance x corresponds to a distance in the second direction D2 between a position on the edge portion 210 and the boundary 230. In more detail, first to n-th distances x1 to xn are sequentially defined from an end of the edge portion 210 and the boundary 230.

In addition, the first and second angles $\Theta_1$ and $\Theta_2$ according to the first to n-th distances x1 to xn are respectively stored in second and third columns of the first look-up table LUT1. In more detail, the first angle $\Theta_1$ corresponding to the first distance x1 is $\Theta_{11}$ and the second angle $\Theta_2$ corresponding to the first distance x1 is $\Theta_{21}$. Similarly, the first angle $\Theta_1$ corresponding to the n-th distance xn is $\Theta_{1n}$ and the second angle $\Theta_2$ corresponding to the n-th distance xn is $\Theta_{2n}$.

The compensation value k1 according to the first to n-th distances x1 to xn is stored in a fourth column of the first look-up table LUT1. For instance, the compensation value k1 corresponding to the first distance x1 is k11 and the compensation value k1 corresponding to the n-th distance xn is k11. The compensation value k1 is calculated by substituting the first and second angles $\Theta_1$ and $\Theta_2$ according to the first to n-th distances x1 to xn into Equation 3.

The second look-up table LUT2 stores the reverse compensation value k2. In more detail, the second look-up table LUT2 stores the first and second angles $\Theta_1$ and $\Theta_2$ in accordance with the distance x and the reverse compensation value k2 as shown in FIG. 8.

In addition, the first and second angles $\Theta_1$ and $\Theta_2$ according to the first to n-th distances x1 to xn are respectively stored in second and third columns of the second look-up table LUT2. In more detail, the first angle $\Theta_1$ corresponding to the first distance x1 is $\Theta_{11}$ and the second angle $\Theta_2$ corresponding to the first distance x1 is $\Theta_{21}$. Similarly, the first angle $\Theta_1$ corresponding to the n-th distance xn is $\Theta_{1n}$ and the second angle $\Theta_2$ corresponding to the n-th distance xn is $\Theta_{2n}$.

The reverse compensation value k2 according to the first to n-th distances x1 to xn is stored in a fourth column of the second look-up table LUT2. For instance, the reverse compensation value k2 corresponding to the first distance x1 is k21 and the reverse compensation value k2 corresponding to the n-th distance xn is k2*n*. The reverse compensation value k2 is calculated by substituting the compensation value k1 according to the first to n-th distances x1 to xn into Equation 4.

Figure 10:
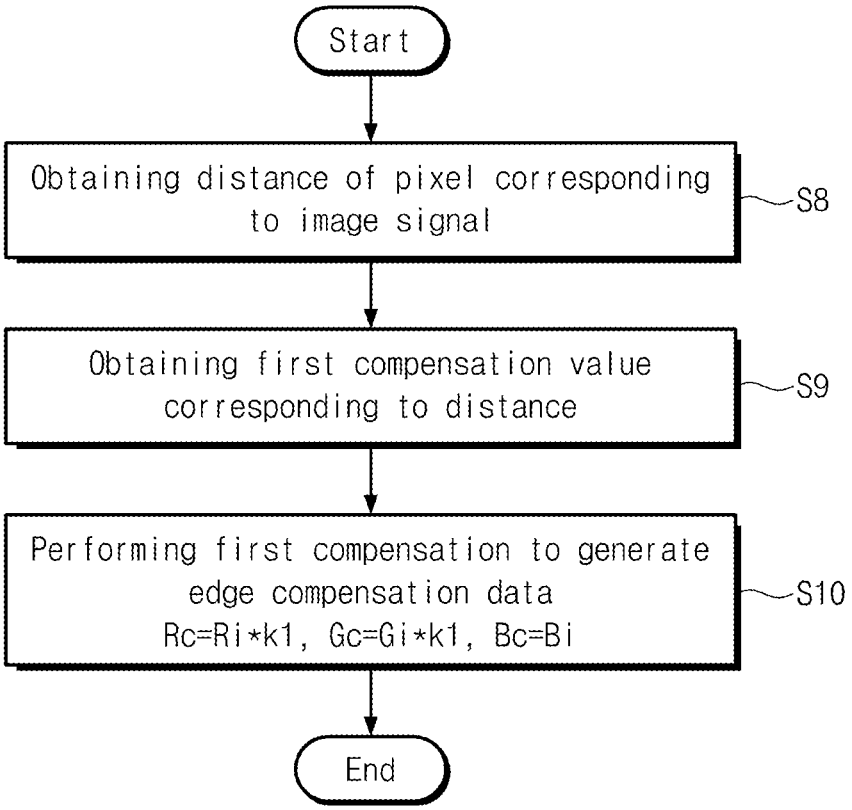
FIG. 10 is a flowchart showing performing of a first compensation shown in FIG. 7.

FIG. 10 is a flowchart showing performing of the first compensation shown in FIG. 7.

Referring to FIG. 10, the compensation block 131 (refer to FIG. 6) compensates for the image signals RGB in the unit of each pixel PX (refer to FIG. 4) to generate the edge compensation data ECD.

The compensation block 131 obtains the distance x of the pixel PX corresponding to the image signals RGB presently applied thereto (S8). Information about the distance x may be included in the image signals RGB, but it should not be limited thereto or thereby. That is, the compensation block 131 may further include a block that calculates the distance x of the pixel PX corresponding to the image signals RGB using clock signals.

Then, the compensation block 131 obtains the compensation value k1 corresponding to the obtained distance x with reference to the first look-up table LUT1 (refer to FIG. 8) (S9).

After that, the compensation block 131 compensates the image signals RGB on the basis of the compensation value k1 corresponding to the distance x to generate the edge compensation data ECD. In more detail, the red and green compensation data Rc and Gc are generated by multiplying the compensation value k1 corresponding to the distance x by each of the red and green image signals R1 and Gi. Meanwhile, the blue compensation data Bc may be generated to have the value of the blue image signal Bi (S10).

Figure 11:
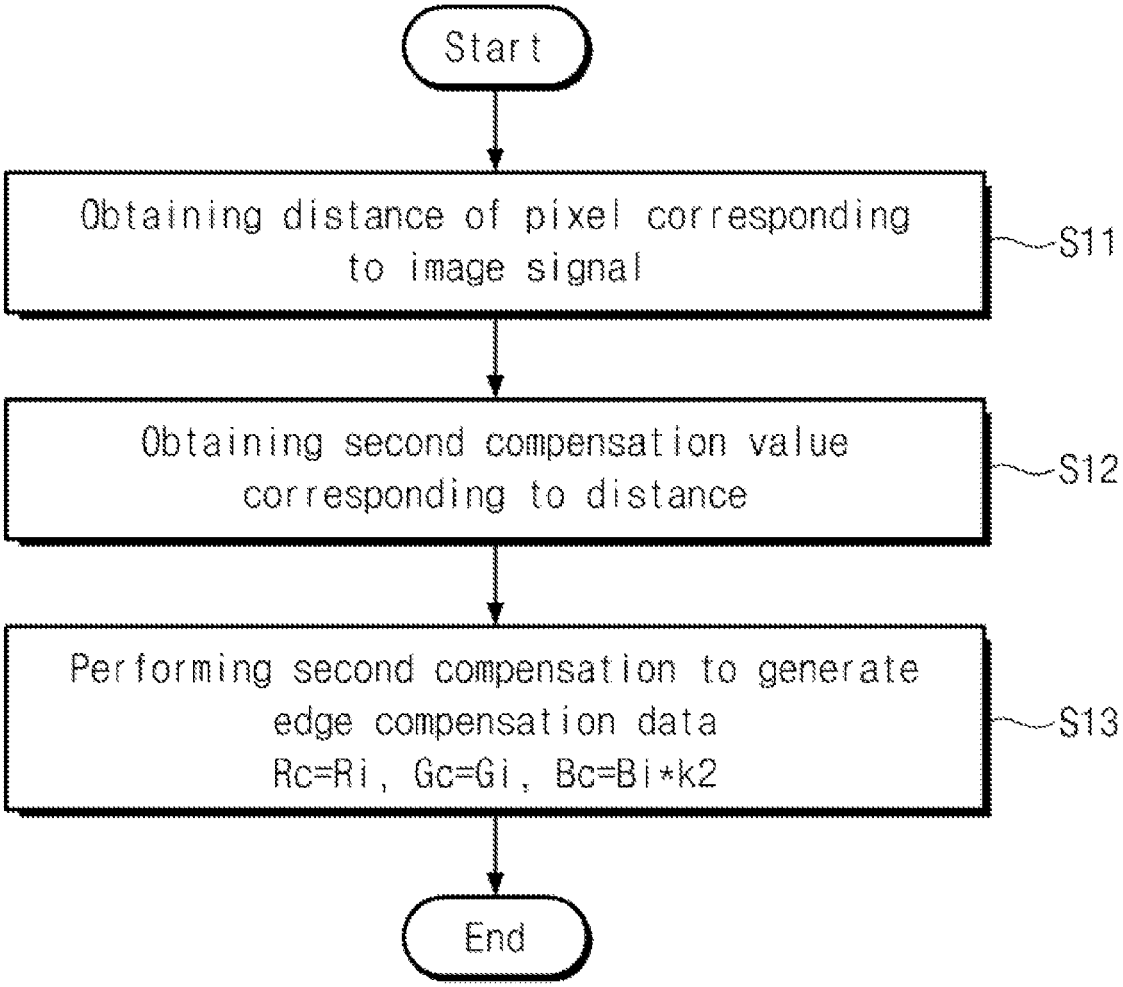
FIG. 11 is a flowchart showing performing of a second compensation shown in FIG. 7.

FIG. 11 is a flowchart showing performing of the second compensation shown in FIG. 7.

Referring to FIG. 11, the compensation block 131 (refer to FIG. 6) compensates for the image signals RGB in the unit of each pixel PX (refer to FIG. 4) to generate the edge image data EID.

The compensation block 131 obtains the distance x of the pixel PX corresponding to the image signals RGB presently applied thereto (S11).

Then, the compensation block 131 obtains the reverse compensation value k2 corresponding to the obtained distance x with reference to the second look-up table LUT2 (refer to FIG. 8).

After that, the compensation block 131 compensates for the image signals RGB on the basis of the reverse compensation value k2 corresponding to the distance x to generate the edge image data EID. In more detail, the blue image data Bo may be generated by multiplying the reverse compensation value k2 corresponding to the distance x by the blue image signal Bi. Meanwhile, the edge red and green image data Ro and Go may be generated to have the red and green image signals Ri and Gi, respectively (S13).

As described above, since the edge image data EID are generated by compensating for the image signals RGB in accordance with the distance x corresponding to the image signals RGB in the unit of one pixel, a difference in color stain, which is caused by the distance x in the edge portion 210, may be removed.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display device comprising:

a backlight unit comprising a first light source substrate comprising a plurality of first light sources arranged in a first direction and a second light source substrate disposed adjacent to the first light source substrate in a second direction and comprising a plurality of second light sources arranged in the first direction;

a display panel disposed to be spaced apart from the backlight unit in a third direction substantially perpendicular to the first and second direction and comprising an edge portion defined along at least one side of the display panel, the edge portion comprising a plurality of edge pixels among a plurality of pixels, each of the plurality of pixels comprising a transistor; and a controller generating an edge image data corresponding to the plurality of edge pixels disposed in the edge portion among the pixels, wherein the edge image data is generated on the basis of a first angle between the third direction and a first imaginary line connecting the edge pixels and the first light sources and a second angle between the third direction and a second imaginary line connecting the edge pixels and the second light sources.

2. The display device of claim 1, wherein the edge portion is disposed in the second direction of the display panel, the display panel comprises a center portion disposed adjacent to the edge portion in a fourth direction opposite to the second direction, the second light source substrate is disposed to correspond to the edge portion, and the first light source substrate is disposed adjacent to the second edge light source substrate in the fourth direction to correspond to the center portion.

3. The display device of claim 2, wherein the controller comprises a compensation block, and the compensation block compensates for edge image signals corresponding to the edge pixels among image signals provided thereto from the outside on the basis of a compensation value (k1) generated based on the first and second angles to generate edge compensation data and generates the edge image data using the edge compensation data.

4. The display device of claim 3, wherein the compensation value (k1) is generated using $\cos^2(\Theta_1)$ and $\cos^2(\Theta_2)$, $\Theta_1$ denotes the first angle, and $\Theta_2$ denotes the second angle.

5. The display device of claim 4, wherein the compensation value (k1) satisfies the following Equation of $$k1 = A\left(\frac{f(\theta_2)}{f(\theta_1)}\right)^{\frac{1}{\gamma}},$$

$f(\Theta_1)$ is equal to $\cos^2(\Theta_1)$, $f(\Theta_2)$ is equal to $\cos^2(\Theta_2)$ , $\gamma$is a gamma tuning value of the display panel, and A is a compensation constant.

6. The display device of claim 5, wherein the edge image signal comprises a red image signal, a green image signal, and a blue image signal, the edge compensation data comprise red, green, and blue compensation data, the red and green compensation data are generated by compensation for the red and green image signals on the basis of the compensation value (k1), and the blue compensation data are generated to have a value of the blue image signal.

7. The display device of claim 6, wherein the red and green compensation data are generated by multiplying the compensation value (k1) by the red and green image signals.

8. The display device of claim 7, wherein the edge image data comprises an edge red image data, an edge green image data, and an edge blue image data, the edge red and green image data are generated to have values of the red and green image signals when the red or green compensation data has a grayscale value greater than a maximum grayscale value, the edge blue image data is generated by multiplying a reverse compensation value (k2) by the blue compensation data, and the reverse compensation value (k2) satisfies the following Equation of $$k2 = \frac{1}{k1}.$$

9. The display device of claim 8, wherein the edge red, green, and blue image data are generated to have the red, green, and blue compensation data respectively when the red and green compensation data have the grayscale value smaller than the maximum grayscale value.

10. The display device of claim 8, wherein the compensation block generates the edge compensation data with reference to a look-up table and the look-up table stores the compensation value (k1) in accordance with the first and second angles.

11. The display device of claim 10, wherein the look-up table comprises a first look-up table storing the compensation value (k1) in accordance with the first and second angles and a second look-up table storing the reverse compensation value (k2) in accordance with the first and second angles, and the compensation block refers to the first look-up table when the red and green compensation data have the grayscale value smaller than the maximum grayscale value and refers to the second look-up table when the red or green compensation data have the grayscale value greater than the maximum grayscale value.

12. The display device of claim 6, wherein the first light source emits a yellow light and the second light source emits a blue light.

13. The display device of claim 12, wherein the backlight unit is operated in a time division fashion in synchronization with first and second fields obtained by timely dividing a frame, the first light source emits the yellow light during the first field, and the second light source emits the blue light during the second field.

14. The display device of claim 13, wherein each of the pixels comprises a red sub-pixel comprising a red color filter, a green sub-pixel comprising a green color filter, and a transparent sub-pixel comprising a transmission part.

15. The display device of claim 14, wherein the first light source substrates are operated during the first field and the second light source substrates are operated during the second field.

16. The display device of claim 5, wherein the edge image signal comprises a red image signal, a green image signal, and a blue image signal, the edge compensation data comprises red, green, and blue compensation data, when the red or green image signal has a grayscale value greater than a maximum grayscale value, the red, green, and blue compensation data are generated to have the red and green image signals, the blue compensation data is generated on the basis of the blue image signal and a reverse compensation value (k2), and the reverse compensation value (k2) satisfies the following Equation of $$k2 = \frac{1}{k1}.$$

17. The display device of claim 14, wherein the blue compensation data is generated by multiplying the reverse compensation value (k2) by the blue image signal.

18. The display device of claim 2, wherein a distance between a center of the first light source substrate and a boundary between the edge portion and the center portion is substantially equal to a distance between the boundary and a center of the second light source substrate.

* * * * *